US008079648B2

(12) United States Patent
Swope et al.

(10) Patent No.: US 8,079,648 B2
(45) Date of Patent: Dec. 20, 2011

(54) COLD-FORMED CUTTING TOOL

(75) Inventors: Chad A. Swope, Bedford, PA (US); William P. Prezlock, Bedford, PA (US)

(73) Assignee: Kennametal Inc., Latrobe, PA (US)

( * ) Notice: Subject to any disclaimer, the term of this patent is extended or adjusted under 35 U.S.C. 154(b) by 128 days.

(21) Appl. No.: 12/321,780

(22) Filed: Jan. 26, 2009

(65) Prior Publication Data

US 2010/0187896 A1 Jul. 29, 2010

(51) Int. Cl.
*E21C 25/10* (2006.01)

(52) U.S. Cl. ..... 299/113; 299/105; 299/110

(58) Field of Classification Search ..... 299/113, 299/111, 110, 105, 104
See application file for complete search history.

(56) References Cited

U.S. PATENT DOCUMENTS

| | | | | |
|---|---|---|---|---|
| 3,807,804 | A | 4/1974 | Kniff | |
| 3,970,158 | A | 7/1976 | Black et al. | |
| 4,181,187 | A | 1/1980 | Lumen | |
| 4,289,211 | A | 9/1981 | Lumen | |
| 4,627,665 | A | 12/1986 | Ewing | |
| 4,850,649 | A | 7/1989 | Beach | |
| 5,161,627 | A | 11/1992 | Burkett | |
| 5,324,098 | A | 6/1994 | Massa et al. | |
| 6,397,652 | B1 | 6/2002 | Sollami | |
| 6,607,249 | B2 * | 8/2003 | Taitt | 299/111 |
| 6,851,758 | B2 | 2/2005 | Beach | |
| 7,360,845 | B2 | 4/2008 | Ojanen | |
| 7,594,703 | B2 * | 9/2009 | Hall et al. | 299/113 |
| 2002/0063467 | A1 * | 5/2002 | Taitt | 299/110 |
| 2008/0129104 | A1 * | 6/2008 | Hall et al. | 299/113 |
| 2008/0246329 | A1 * | 10/2008 | Hall et al. | 299/113 |

OTHER PUBLICATIONS

PCT/US10/21946 to Kennametal, Notification of Transmittal of International Search Report and Written Opinion (2 pages) Mar. 29, 2010.

PCT/US10/21946 to Kennametal, International Search Report, (2 pages) Mar. 29, 2010.

PCT/US10/21946 to Kennametal, Written Opinion of the International Searching Authority (7 pages) Mar. 29, 2010.

* cited by examiner

*Primary Examiner* — Frederic L Lagman
(74) *Attorney, Agent, or Firm* — Matthew W. Smith

(57) ABSTRACT

A cutting tool body that includes an elongate steel body, which has an axial forward end and an axial rearward end. The elongate steel body contains at the axial forward end thereof a cold-headed socket. The cold-headed socket has an axial forward open end, an axial rearward closed surface, and a side socket surface extending between the axial forward open end and the axial rearward closed surface. The side socket surface contains an undercut adjacent the axial rearward closed surface.

18 Claims, 3 Drawing Sheets

COLD-FORMED CUTTING TOOL

BACKGROUND OF THE INVENTION

The present invention relates to a cutting tool, such as, for example, a rotatable cutting tool which is a component of an earth-working apparatus, used to impinge upon earth strata such as, for example, ore-bearing or coal-bearing earth (or mineral) formations, as well as asphaltic roadway material. More specifically, the present invention pertains to such a cutting tool that includes a cutting tool body that contains a hard cutting tip at the axial forward end thereof. The cutting tool body, and especially the portion of the cutting tool body adjacent the axial forward socket that receives the hard cutting tip, has improved strength properties, as well as improved retention of the hard cutting tip to the cutting tool body.

Heretofore, a rotatable cutting tool has been used to impinge upon earth strata, such as for example, ore-bearing or coal-bearing earth (or mineral) formations, as well as asphaltic roadway material and the like. Such a rotatable cutting tool typically comprises an elongate cutting tool body that has an axial forward end and an axial rearward end. In one embodiment of such a cutting tool, the cutting tool body has a socket at the axial forward end wherein the socket receives a hard cutting tip. In such an embodiment, the hard cutting tip is affixed to the cutting tool body by brazing or the like.

As can be appreciated, during operation the entire rotatable cutting tool is typically subjected to a variety of extreme cutting forces in an abrasive and erosive environment. It would be undesirable for the cutting tool body to prematurely wear or fail (whether it be through catastrophic fracture or the like or through abrasive or erosive wear) prior to the hard cutting tip wearing to the end point of its useful life. Further, would be undesirable for the hard cutting tip to become detached prematurely from the cutting tool body, whether it be through catastrophic fracture or the like, prior to the hard cutting tip or the cutting tool body wearing to the end point of their useful life.

In either circumstance, the rotatable cutting tool would have to replaced prior to the normally scheduled time for replacement. Further, the premature failure of the rotatable cutting tool would negatively impact the cutting or milling efficiency of the overall earthworking (e.g., mining) apparatus. It thus becomes apparent that it is important that the cutting tool body possess the requisite strength to maintain its integrity during the intended useful life of the rotatable cutting tool. It is also apparent that it is important for the hard cutting tip to remain attached to the cutting tool body throughout the intended useful life of the rotatable cutting tool.

Heretofore, a cold-heading or cold-forming process has been used to form some portions of the cutting tool body. One exemplary patent is U.S. Pat. No. 4,627,665 to Ewing et al. that shows the cold forming of a cutting tool body. However, a number of steps are necessary to form certain portion of the cutting tool body. For example, the puller groove is formed via a separate roll-forming operation while the socket and the axial forward portion of the rotatable cutting tool is formed via a cold-heading process. U.S. Pat. No. 6,397,652 to Sollami is another example of a patent that shows a cutting tool body formed by a cold forming process.

U.S. Pat. No. 7,360,845 B2 to Ojanen is still another example of a cutting tool body formed by a cold forming process. This patent shows a cold-headed puller groove and a cold-headed socket. However, the cold-headed socket of this patent is a shallow socket. In the specific embodiment, the shallow socket has a depth equal to about one-seventh of the diameter of the shallow socket.

It can therefore be appreciated that it would be desirable to provide an improved cutting tool body, including a rotatable cutting tool body, that exhibits improved strength properties. It can also be appreciated that it would be desirable to provide an improved cutting tool body, including a rotatable cutting tool body, that minimizes the tendency to prematurely wear or fail (whether it be through catastrophic fracture or the like or through abrasive or erosive wear) prior to the hard cutting tip wearing to the end point of its useful life. Further, it would be desirable to provide an improved cutting tool, including a rotatable cutting tool, that minimizes the tendency of the hard cutting tip to become detached prematurely from the cutting tool body, whether it be through catastrophic fracture or the like, prior to the hard cutting tip or the cutting tool body wearing to the end point of their useful life.

SUMMARY OF THE INVENTION

In one form thereof, the invention is a cutting tool body that includes an elongate steel body, which has an axial forward end and an axial rearward end. The elongate steel body contains at the axial forward end thereof a cold-headed socket. The cold-headed socket has an axial forward open end, an axial rearward closed surface, and a side socket surface extending between the axial forward open end and the axial rearward closed surface. The side socket surface contains an undercut adjacent the axial rearward closed surface.

In another form thereof, the invention is a rotatable cutting tool that comprises a cutting tool body which has an axial forward end and an axial rearward end. The cutting tool body contains at the axial forward end thereof a cold-headed socket having a central longitudinal socket axis. The cold-headed socket has an axial forward open end, an axial rearward closed surface, and the axial forward open end of the cold-headed socket has a transverse open end width. There is a side socket surface extending between the axial forward open end and the axial rearward closed surface. The side socket surface is generally parallel to the central longitudinal socket axis. The side socket surface has a longitudinal socket surface length. The side socket surface contains an undercut adjacent the axial rearward closed surface. The longitudinal socket surface length is greater than the transverse open end width. The cutting tool further includes a hard cutting tip. The cold-headed socket receives the axial rearward base section whereby the hard cutting tip being affixed to the cutting tool body.

In yet another form thereof, the invention is a rotatable cutting tool that comprises a cutting tool body that has an axial forward end and an axial rearward end. The cutting tool body contains at the axial forward end thereof a cold-headed socket, which has a central longitudinal socket axis. The cold-headed socket has an axial forward open end, an axial rearward closed surface, and the axial forward open end of the cold-headed socket has a transverse open end width. The cold-headed socket has a side socket surface which extends between the axial forward open end and the axial rearward closed surface. The side socket surface is generally parallel to the central longitudinal socket axis. The side socket surface has a longitudinal socket surface length. The side socket surface contains an undercut adjacent the axial rearward closed surface. The longitudinal socket surface length is between about 0.20 times and about four times greater than the transverse open end width. The cutting tool includes a hard cutting tip that has an axial rearward base section having a longitudinal base length and an axial forward tip section.

The cold-headed socket receives the axial rearward base section whereby the hard cutting tip being affixed to the cutting tool body.

BRIEF DESCRIPTION OF THE DRAWINGS

The following is a brief description of the drawings which form a part of this patent application.

DETAILED DESCRIPTION

Figure 1:
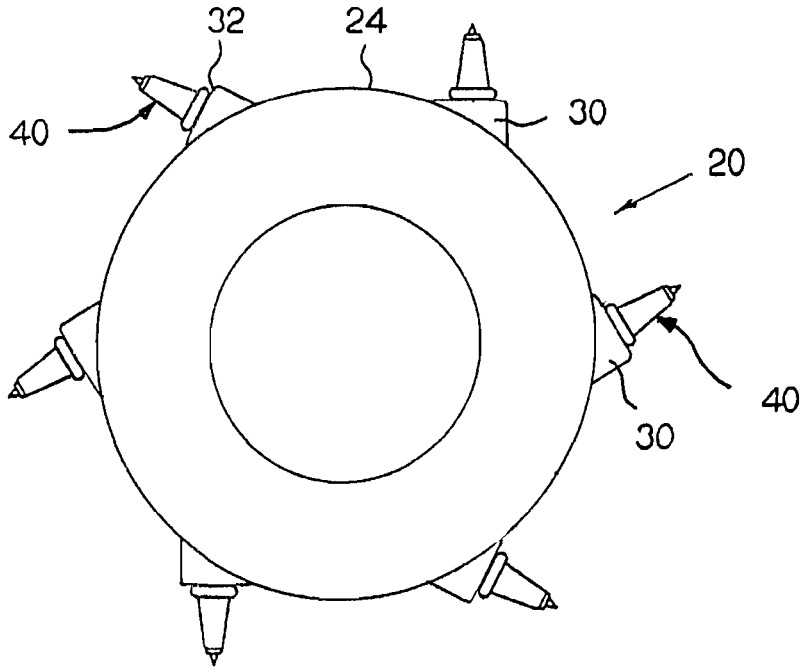
FIG. 1 is a mechanical schematic side view of a rotatable drum of a mining apparatus wherein the drum carries a plurality of cutting tool holders wherein each one of the cutting tool holders rotatably carries a rotatable cutting tool.

Referring to the drawings, FIG. 1 shows in schematic form a rotatable drum generally designated as 20 that has a peripheral surface 24. The rotatable drum 20 is a part of an earthworking apparatus (not illustrated) that is used to impact and disintegrate earth strata (e.g., coal, there minerals, asphaltic material on roadways, rock and the like). Exemplary earthworking apparatus include mining machines that mine coal or ore deposits, road planing (or milling) machines that plane or mill roadway surfaces, and like machines that impact and disintegrate strata or substrates.

A plurality of cutting tool holders (or blocks) 30 are affixed (typically by welding) (typically in a helical pattern) to the peripheral surface 24 of the rotatable drum 20. Each one of the cutting tool holders 30 carries a rotatable cutting tool generally designated as 40. There should be an appreciation that, at least in some aspects, there is no intention that the present invention be limited to a rotatable cutting tool. The claims define the true spirit and scope of the present invention.

Figure 2:
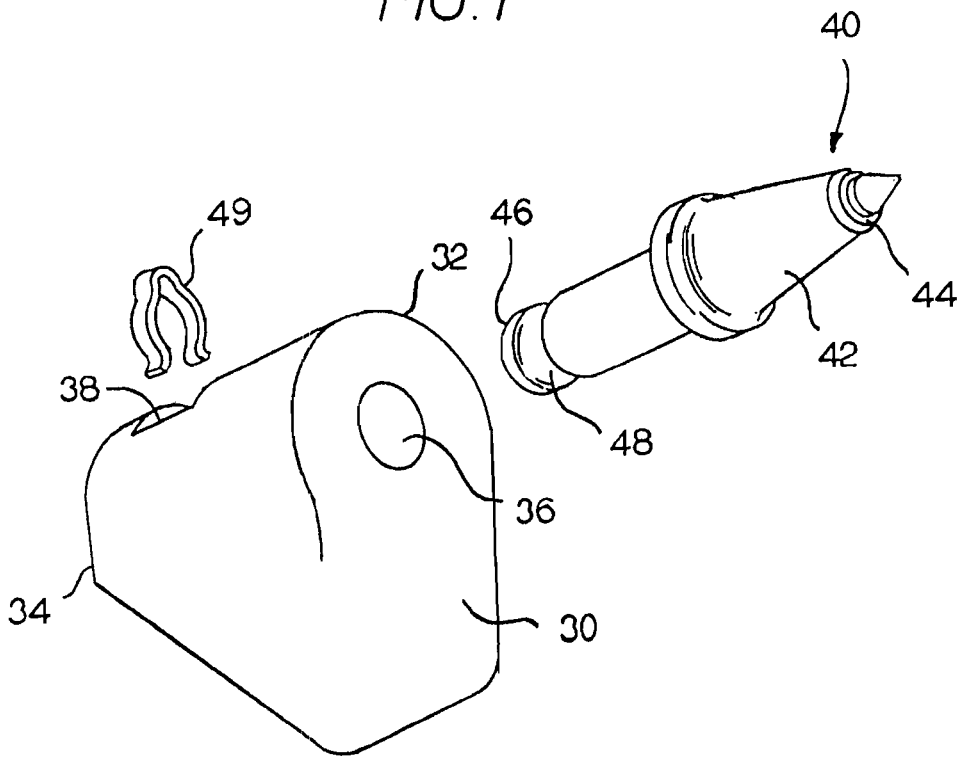
FIG. 2 is an isomeric view of a specific embodiment of a rotatable cutting tool exploded from the bore of a cutting tool holder and a retainer clip exploded from the rearward opening of the cutting tool holder.

As shown in FIG. 2, each one of the cutting tool holders 30 has a forward end 32 and a rearward end 34. The cutting tool holder 30 contains a longitudinal bore 36 that opens at the forward end 32 of the cutting tool holder 30. The cutting tool holder 30 further contains a rearward opening 38 adjacent the rearward end 34 whereby rearward opening 38 is in communication with the longitudinal bore 36.

Figure 3:
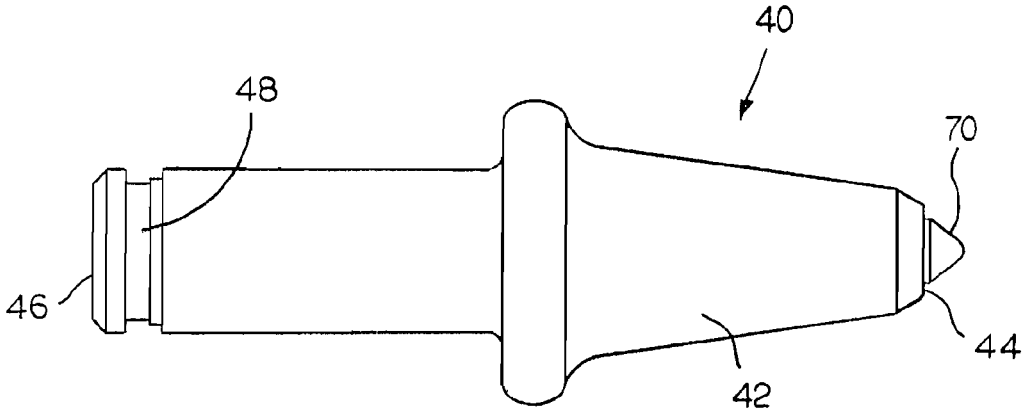
FIG. 3 is a side view of a specific embodiment of a rotatable cutting tool wherein the hard cutting tip is affixed to the elongate cutting tool steel body.
Figure 4A:
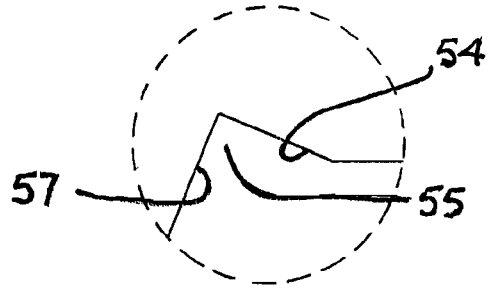
FIG. 4A is an enlarged view of the undercut.
Figure 4:
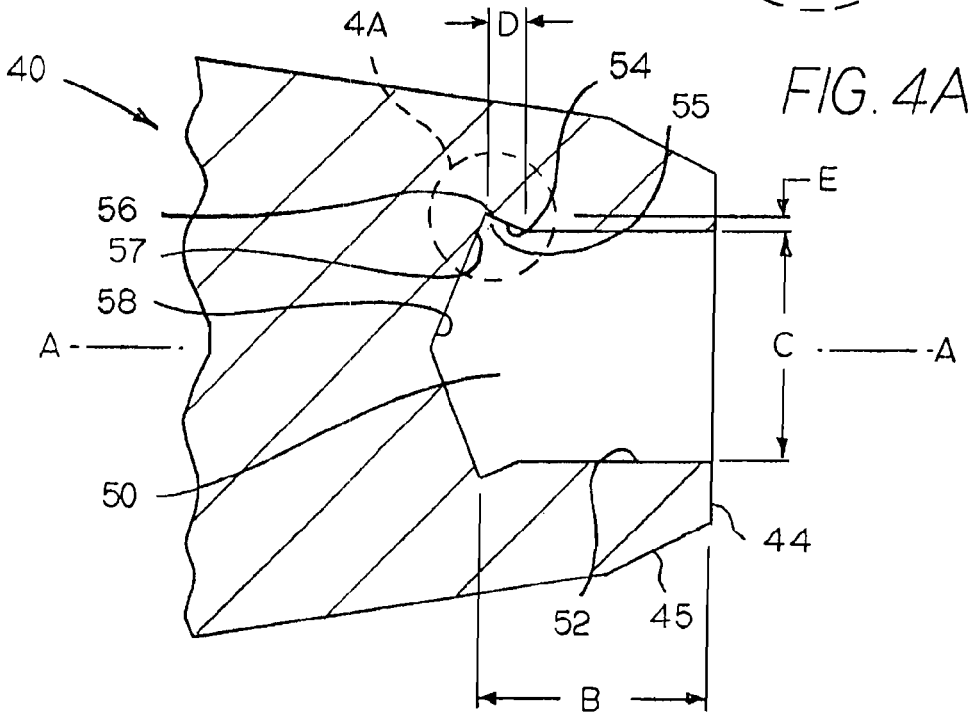
FIG. 4 is a cross-sectional view of the axial forward portion of the cutting tool body of the rotatable cutting tool embodiment of FIG. 3 showing the geometry of the cold-headed deep socket.

Still referring to FIG. 2, as well as FIG. 3 and FIG. 4, rotatable cutting tool 40 includes an elongate cutting tool body 42. The elongate cutting tool body 42 can be made of steel. A typical grade of steel suitable for the elongate cutting tool body 42 is a grade 15B steel. There should be an appreciation that there is no intention to limit the scope of the invention by the recitation of specific steel compositions. It is the claims that define the true spirit and scope of the invention. Cutting tool body 42 has an axial forward end 44 and an axial rearward end 46. Cutting tool body 42 contains a retainer groove 48 adjacent the axial rearward end 46.

Cutting tool body 42 contains a cold-headed socket 50 at the axial forward end 44 thereof. The cold-headed socket 50 is described in more detail hereinafter. In the specific embodiment of FIG. 4, the cold-headed socket 50 can be considered to be a deep socket due to the geometrical nature thereof. In this regard, there should be an understanding that the use of the term "deep socket" refers to a socket that has a maximum depth in the axial longitudinal direction that is greater than the maximum width, which is in the transverse direction, of the deep socket. There should be an appreciation that the present invention, at least in some aspects, is not intended to be limited to a so-called deep socket. The claims define the true spirit and scope of the present invention.

Referring to FIG. 2, it can be appreciated that the rotatable cutting tool 40 is rotatably retained within the bore 36 of the cutting tool holder 30 by the engagement of the retainer clip 49 in the retainer groove 48. The retainer clip 49 passes through the opening 38 to engage the retainer groove 48. Generally speaking, such a structure is known in the art to retain the cutting tool within the bore of a holder. It should be appreciated that other styles of retainers, and corresponding axial rearward portions of the cutting tool body, can be used to rotatably retain the cutting tool within the bore of the holder. In this regard, exemplary retainer arrangements, some of which may require a somewhat different geometry of the axial reward portion of the cutting tool body (as well as the cutting tool holder), are shown and described in the following United States Patents: U.S. Pat. No. 5,324,098 to Massa et al., U.S. Pat. No. 6,851,758 to Beach, and U.S. Pat. No. 4,850,649 to Beach et al.

Figure 5:
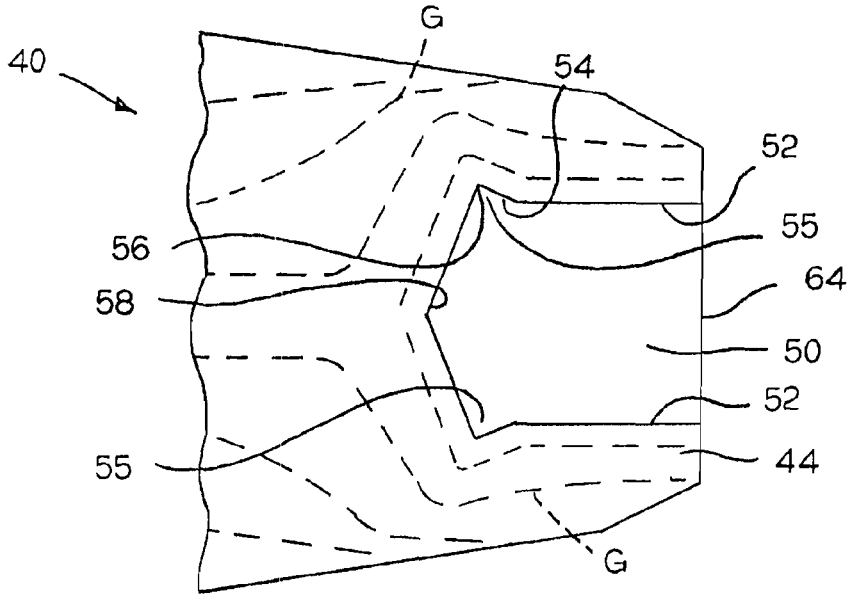
FIG. 5 is a cross-sectional view of the axial forward portion of the cutting tool body of the rotatable cutting tool embodiment of FIG. 3 showing the grain orientation of the portion of the cutting tool steel body adjacent to the deep socket.

FIG. 4 and FIG. 5 present a cross-sectional view of a portion of the cutting tool steel body 42 adjacent to the axial forward end showing the cold-headed socket 50. The cold-headed socket has a central longitudinal socket axis A-A. There should be an appreciation that the cold-headed socket 50 is made via a cold forming or cold-heading process. The frusto-conical surface 45 of the cutting tool body is also made via a cold forming or cold-heading process.

Socket 50 has a cylindrical side socket surface 52 that extends in an axial rearward direction from the axial forward open end 64 (see FIG. 5) of the socket 50 toward the axial rearward closed surface 58. The axial rearward closed surface 58 has a generally conical geometry. The side socket surface 52 is generally parallel to the central longitudinal axis A-A of the socket 50. The side surface 52 exhibits a substantial smoothness due the formation of the socket 50 by a cold forming process.

The side socket surface 52 has a longitudinal socket surface length B. The longitudinal side socket surface B includes an undercut 55, which is described in more detail hereinafter. The axial forward open end 64 of the cold-headed socket 52 has a transverse open end width C. In the specific embodiment, the longitudinal side socket surface length B is greater than the transverse open end width C. In one range, the longitudinal side socket surface length B is between about 0.20 times and about four times greater than the transverse open end width C. In another range, the longitudinal socket surface length B is between about 0.60 times and about 2.5 times greater than the transverse open end width C. In still another range, the longitudinal socket surface length B is between about 0.80 times and about 1.8 times greater than the transverse open end width C. In a preferred embodiment, the longitudinal socket surface length B is about 0.9 times greater than the transverse open end width C.

Socket 50 further has an undercut 55 adjacent the axial rearward closed surface 58. The undercut 55 is defined by a forward radially outward surface 54 that extends in a radial outward direction from the central longitudinal axis A-A of the deep socket 50. The radially outward surface 54 terminates at a radially outward periphery 56 contiguous with the radially outward surface 54. The undercut 55 is further defined by a rearward radial outward surface 57. The rearward radial outward surface 57 extends in a radial outward direction and is contiguous with the axially rearward closed surface 58.

In regard to the dimensioning of the undercut 55, in one range, the undercut 55 extends along the side socket surface 52 from the axial rearward closed surface 58 toward the axial forward open end 64 an undercut longitudinal distance D equal to between about 0.06 and about 0.33 of the longitudinal socket surface length B. In another range, the undercut 55 extends along the side socket surface 52 from the axial rearward closed end 58 toward the axial forward open end 64 an undercut longitudinal distance D equal to between about 0.12 and about 0.25 of the longitudinal socket surface length B. In still another range, the undercut 55 extends along the side socket surface 52 from the axial rearward closed end 58 toward the axial forward open end 64 an undercut longitudinal distance D equal to between about 0.15 and about 0.20 of the longitudinal socket surface length B. In a preferred embodiment, the undercut 55 extends along the side socket surface 52 from the axial rearward closed end 58 toward the axial forward open end 64 an undercut longitudinal distance D equal to between about 0.18 the longitudinal socket surface length B.

In further reference to the undercut 55, the undercut 55 extends in a radial outward direction from the central longitudinal socket axis A-A an undercut radial distance E from the side socket surface 52. In one range, the undercut 55 extends in a radial outward direction an undercut radial distance E away from the side socket surface 52 equal to between about 0.03 and about 0.06 of the transverse open end width C. In another range, the undercut 55 extends in a radial outward direction an undercut radial distance E away from the side socket surface 52 equal to between about 0.04 and about 0.05 of the transverse open end width C.

Figure 6:
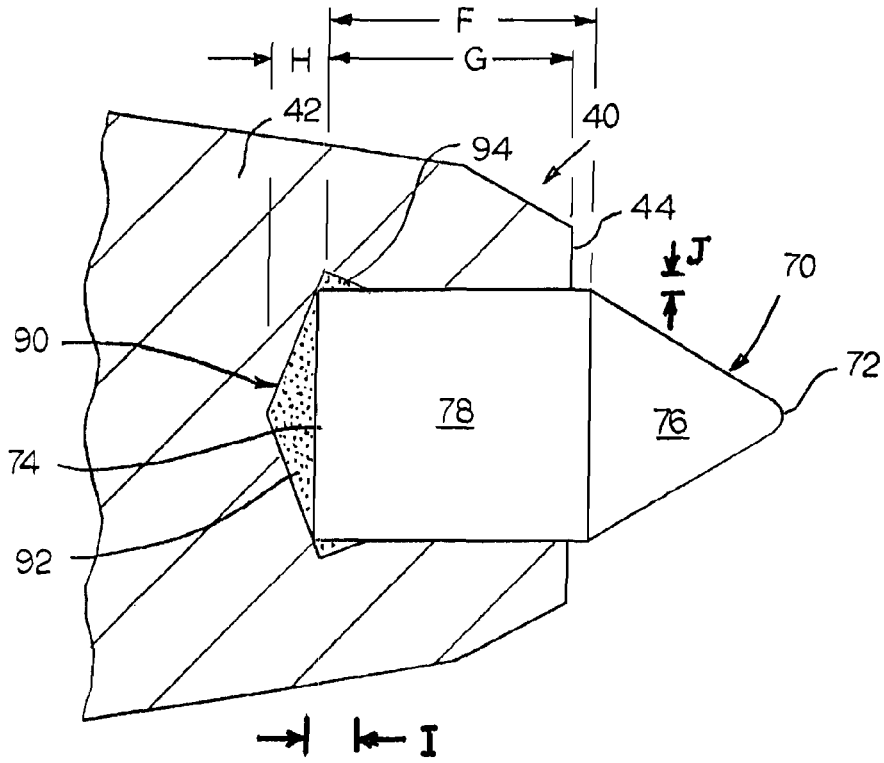
FIG. 6 is a cross-sectional view of the axial forward portion of the cutting tool body of the rotatable cutting tool embodiment of FIG. 3 wherein the hard cutting tip is brazed into the deep socket.

Referring to FIG. 6, the hard cutting tip 70 is shown affixed by brazing within the cold-headed socket 50. The hard cutting tip 70 has an axial forward end 72 and an axial rearward end 74. The hard cutting tip 70 further has a generally conical tip section 76 adjacent to the axial forward end 72, and a longitudinal base section 78 adjacent to the axial rearward end 74. Although the braze joint will be describe din more detail hereinafter, the overall braze joint is generally illustrated as 90.

In reference to FIG. 6, when the hard cutting tip 70 is received within the cold-headed socket 50. The overall axial length of the longitudinal base section 78 is distance F. It is apparent that a majority of the longitudinal base section 78 is within the volume of the socket 50. The portion of the longitudinal base section 78 within the socket 50 extends a distance G from the axial rearward end 74 toward the axial forward end 72 of the hard cutting tip 70. Further, it is apparent that the axial rearward closed surface 58 is spaced apart from the axial rearward end 74 of the hard cutting tip 70 to form a rearward volume. The maximum distance between the axial rearward end 74 of the hard cutting tip 70 and the axial rearward closed surface 58 is distance H. This rearward volume forms a volume for braze alloy to exist to create a rearward braze joint 92 between the cutting tool body 42 and the hard cutting tip 70.

FIG. 6 further shows that the undercut 55 defines a undercut volume, which provides a volume for braze alloy to exist to create an undercut braze joint 94 between the cutting tool body 42 and the hard cutting tip 70. There should be an understanding that suitable braze alloys are those typically used to affix hard inserts to the cutting tool body and are known to those skilled in the art. The undercut braze joint 94 extends along the base section 78 of the hard cutting tip 70 an undercut braze joint longitudinal distance I equal to between about 0.06 and about 0.33 of the longitudinal base length G of the axial rearward base section 78 received within the cold-headed socket 50. In one range, the undercut braze joint 94 extends along the base section 78 of the hard cutting tip 70 an undercut braze joint longitudinal distance I equal to between about 0.12 and about 0.25 of the longitudinal base length G of the axial rearward base section 78 received within the cold-headed socket 50. In one range, the undercut braze joint 94 extends along the base section 78 of the hard cutting tip 70 an undercut braze joint longitudinal distance I equal to between about 0.15 and about 0.20 of the longitudinal base length G of the axial rearward base section 78 received within the cold-headed socket 50. In a specific embodiment, the undercut braze joint 94 extends along the base section 78 of the hard cutting tip 70 an undercut braze joint longitudinal distance I equal to about 0.18 of the longitudinal base length G of the axial rearward base section 78 received within the cold-headed socket 50.

The overall braze joint 90 thus comprises a rearward braze joint 92 and an undercut braze joint 94. By providing an overall braze joint 90 with these two separate sections, i.e., a rearward braze joint 92 and an undercut braze joint 94, there has been an improvement of the retention capability of the cutting tool. The undercut braze joint 94 extends in a radial outward direction an undercut braze joint radial distance J away from the hard cutting tip 70. The undercut braze joint radial distance J is equal to between about 0.03 and about 0.06 of the transverse open end width C. In another range, the undercut braze joint radial distance J is equal to between about 0.04 and about 0.05 of the transverse open end width C.

FIG. 5 is a schematic side view that shows the direction of the grain (G) of the metal (e.g., steel) in the cold-formed cutting tool body. As can be seen from FIG. 5, the grain (G) of the steel generally follows the contour of the surface of the cutting tool body including generally following the contour of the surface of the deep socket 50. By generally following the contour of the surface of the cutting tool body, as well as the surface of the deep socket 50, the cutting tool body possesses increased strength.

All patents, patent applications, articles and other documents identified herein are hereby incorporated by reference herein. Other embodiments of the invention may be apparent to those skilled in the art from a consideration of the specification or the practice of the invention disclosed herein. It is intended that the specification and any examples set forth herein be considered as illustrative only, with the true spirit and scope of the invention being indicated by the following claims.

What is claimed is:

1. A cutting tool body comprising:

an elongate steel body having an axial forward end and an axial rearward end;

the elongate steel body containing at the axial forward end thereof a cold-headed socket;

the cold-headed socket having an axial forward open end, an axial rearward closed surface, and a side socket surface extending between the axial forward open end and the axial rearward closed surface, and the side socket surface containing an undercut adjacent the axial rearward closed surface; and wherein essentially the entire undercut continually extending in a radial outward direction as the undercut extends along the side socket surface in a direction toward the axial rearward closed surface and intersecting the axial rearward closed surface.

2. The cutting tool body according to claim 1 wherein the cold-headed socket having a central longitudinal socket axis, the side socket surface being generally parallel to the central longitudinal socket axis, and the side socket surface having a longitudinal socket surface length, and the axial forward open end of the cold-headed socket having a transverse open end width, and the longitudinal socket surface length being greater than the transverse open end width.

3. The cutting tool body according to claim 2 wherein the longitudinal socket surface length being between about 0.20 times and about four times greater than the transverse open end width.

4. The cutting tool body according to claim 2 wherein the longitudinal socket surface length being between about 0.60 times and about 2.5 times greater than the transverse open end width.

5. The cutting tool body according to claim 2 wherein the undercut extending along the side socket surface from the axial rearward closed end toward the axial forward open end an undercut longitudinal distance equal to between about 0.12 and about 0.25 of the longitudinal socket surface length.

6. The cutting tool body according to claim 2 wherein the undercut extending along the side socket surface from the axial rearward closed end toward the axial forward open end an undercut longitudinal distance equal to between about 0.15 and about 0.20 of the longitudinal socket surface length.

7. The cutting tool body according to claim 2 wherein the undercut extending in a radial outward direction an undercut radial distance away from the side socket surface equal to between about 0.03 and about 0.06 of the transverse open end width.

8. The cutting tool body according to claim 2 wherein the undercut extending in a radial outward direction an undercut radial distance away from the side socket surface equal to between about 0.04 and about 0.05 of the transverse open end width.

9. The cutting tool body of claim 1 wherein the steel body having a grain orientation, and the direction of the grain orientation adjacent the cold-headed socket generally corresponding to the contour of the side socket surface.

10. A rotatable cutting tool comprising:

a cutting tool body having an axial forward end and an axial rearward end;

the cutting tool body containing at the axial forward end thereof a cold-headed socket having a central longitudinal socket axis;

the cold-headed socket having an axial forward open end, an axial rearward closed surface, and the axial forward open end of the cold-headed socket having a transverse open end width;

a side socket surface extending between the axial forward open end and the axial rearward closed surface, the side socket surface being generally parallel to the central longitudinal socket axis, the side socket surface having a longitudinal socket surface length, and the side socket surface containing an undercut adjacent the axial rearward closed surface;

the longitudinal socket surface length being greater than the transverse open end width;

a hard cutting tip, and the cold-headed socket receiving the axial rearward base section whereby the hard cutting tip being affixed to the cutting tool body by brazing; and when the hard cutting tip is received within the cold-headed socket, at least some of the axial rearward closed surface being spaced apart from the hard cutting tip to form a rearward volume containing a rearward braze joint between the cutting tool body and the hard cutting tip, and the undercut defining a undercut volume containing an undercut braze joint between the cutting tool body and the hard cutting tip.

11. The rotatable cutting tool according to claim 10 wherein the hard cutting tip having an axial rearward base section having a longitudinal base length and an axial forward tip section, the undercut braze joint extending along the base section of the hard cutting tip an undercut braze joint longitudinal distance equal to between about 0.12 and about 0.25 of the longitudinal base length of the axial rearward base section received within the cold-headed socket.

12. The rotatable cutting tool according to claim 10 wherein the undercut braze joint extending in a radial outward direction an undercut braze joint radial distance away from the hard cutting tip, and the undercut braze joint radial distance being equal to between about 0.03 and about 0.06 of the transverse open end width.

13. The rotatable cutting tool according to claim 10 wherein the cutting tool body being made of steel, and the cutting tool body having a grain orientation, and the direction of the grain orientation adjacent the cold-headed socket generally corresponding to the contour of the side socket surface.

14. A rotatable cutting tool comprising:

a cutting tool body having an axial forward end and an axial rearward end;

the cutting tool body containing at the axial forward end thereof a cold-headed socket having a central longitudinal socket axis;

the cold-headed socket having an axial forward open end, an axial rearward closed surface, and the axial forward open end of the cold-headed socket having a transverse open end width;

a side socket surface extending between the axial forward open end and the axial rearward closed surface, the side socket surface being generally parallel to the central longitudinal socket axis, the side socket surface having a longitudinal socket surface length, and the side socket surface containing an undercut adjacent the axial rearward closed surface;

the longitudinal socket surface length being between about 0.20 times and about four times greater than the transverse open end width;

a hard cutting tip, the hard cutting tip having an axial rearward base section having a longitudinal base length and an axial forward tip section, and the cold-headed socket receiving the axial rearward base section whereby the hard cutting tip being affixed to the cutting tool body; and wherein essentially the entire undercut continually extending in a radial outward direction as the undercut extends along the side socket surface in a direction toward the axial rearward closed surface and intersecting the axial rearward closed surface.

15. The rotatable cutting tool according to claim 14 wherein the hard cutting tip being brazed to the cutting tool body; and when the hard cutting tip is received within the cold-headed socket, at least some of the axial rearward closed surface being spaced apart from the hard cutting tip to form a bottom volume containing a bottom braze joint between the cutting tool body and the hard cutting tip, and the undercut defining a undercut volume containing an undercut braze joint between the cutting tool body and the hard cutting tip; and the undercut braze joint extending along the base section of the hard cutting tip an undercut braze joint longitudinal distance equal to between about 0.12 and about 0.25 of the longitudinal base length of the axial rearward base section received within the cold-headed socket.

16. The rotatable cutting tool according to claim 14 wherein the hard cutting tip being brazed to the cutting tool body; and when the hard cutting tip is received within the cold-headed socket, at least some of the axial rearward closed surface being spaced apart from the hard cutting tip to form a bottom volume containing a bottom braze joint between the cutting tool body and the hard cutting tip, and the undercut defining a undercut volume containing an undercut braze joint between the cutting tool body and the hard cutting tip; and the undercut braze joint extending in a radial outward direction an undercut braze joint radial distance away from the hard cutting tip, and the undercut braze joint radial distance being equal to between about 0.03 and about 0.06 of the transverse open end width.

17. The rotatable cutting tool according to claim 14 wherein the cutting tool body further having a cold-headed frusto-conical surface at the axial forward end thereof.

18. The rotatable cutting tool according to claim 15 wherein the undercut braze joint having a thickness increasing along it entire axial length in the direction of the axial rearward closed surface.

* * * * *